United States Patent [19]

Brown

[11] Patent Number: 5,062,233

[45] Date of Patent: Nov. 5, 1991

[54] SAFETY DEVICE FOR A FIREARM

[76] Inventor: Franklin C. Brown, 1967 Genoa Ave., Akron, Ohio 44305

[21] Appl. No.: 641,452

[22] Filed: Jan. 14, 1991

Related U.S. Application Data

[63] Continuation-in-part of Ser. No. 391,883, Aug. 8, 1989.

[51] Int. Cl.[5] ..... F41A 17/44

[52] U.S. Cl. ..... 42/70.11

[58] Field of Search ..... 42/70.11

[56] References Cited

U.S. PATENT DOCUMENTS

| | | | |
|---|---|---|---|
| 2,478,098 | 8/1949 | Hansen | 42/70.11 |
| 2,763,081 | 9/1956 | Huckabee | 42/70.11 |
| 3,022,598 | 2/1962 | Wikstrom | 42/70.11 |
| 3,137,957 | 6/1964 | Ingalls | 42/70.11 |
| 3,368,297 | 2/1968 | Lentz | 42/70.11 |
| 3,708,901 | 1/1973 | Wolter | 42/70.11 |
| 3,710,490 | 1/1973 | Cornett et al. | 42/70.11 |
| 3,720,014 | 3/1973 | Goodrich | 42/70.11 |
| 4,969,284 | 11/1990 | Healey et al. | 42/70.11 |

FOREIGN PATENT DOCUMENTS

| | | | |
|---|---|---|---|
| 22837 | 12/1912 | Norway | 42/70.11 |

OTHER PUBLICATIONS

Guns & Ammo, Dec. 1989, p. 18.

*Primary Examiner*—Richard W. Wendtland
*Attorney, Agent, or Firm*—Oldham & Oldham, Co.

[57] ABSTRACT

A safety device for a firearm which prevents ammunition from being introduced into the chamber and provides a visible indication that the firearm is not loaded. The device incorporates a plug attached to a cable, and plug ring adapters, one being selected which corresponds to the barrel diameter. The cable is inserted into the barrel from the chamber and pulled through until the plug/plug ring combination is seated against the chamber opening. This device is held in place by a restricting means. The restricting means can be locked in place, thereby preventing unintended removal.

10 Claims, 4 Drawing Sheets

SAFETY DEVICE FOR A FIREARM

This is a continuation in part of pending application 07/391,883 filed 8/8/89.

The present invention relates to a safety device for a firearm. More specifically it relates to an economical safety device for a firearm which prevents ammunition from being introduced into the chamber. Even more specifically, it relates to a safety device for a firearm which, when the device is in place, provides an easily visible indication that the firearm is not loaded.

DISCUSSION OF THE PRIOR ART

The number of accidental shootings caused by guns that were not thought to be loaded or by guns that were in the hands of inexperienced operators is well known and publicized. Guns are a leading cause of accidental death for children ages 14 and under. Nearly 90% of accidental shootings occur in the home of the victim or that of a close friend or relative. Although many parents attempt to hide a gun kept at home, children often know where it is hidden or later discover its location. Public safety messages are broadcast through various media sources, but accidental shootings still occur at an alarming rate.

Currently, the use of locks which restrict the trigger mechanism are well known. These locks prevent an operator from discharging the firearm by restraining the trigger. However, with such trigger locks in place, ammunition can still be loaded into the firearm's chamber. A loaded gun, even with a trigger lock in place is still a potential danger. There have been reports of the accidental firing of firearms which had trigger locks in place. Many of these incidents occurred through the mishandling of the firearm.

In other art, a lock for handguns was developed which utilized a rod inserted into the barrel and locked in place. However, its use was confined to handguns and the item was substantially more expensive to produce and manufacture.

SUMMARY OF THE INVENTION

The present invention, generally stated, provides a new safety device for use with a firearm, such that it prevents ammunition from being introduced into the chamber and, when in place, presents an easily visible indication that the gun is not loaded.

It is an object of this invention to provide a safety device for a firearm, such that said device can be used on a wide variety of firearms, including but not limited to, rifles, handguns and shotguns.

It is also an object of this invention to provide a safety device for firearms such that when said device is in place, ammunition cannot be introduced into the chamber.

It is also an object of this invention to provide a highly visible means for assuring that a gun, utilizing such device, is not loaded.

It is also an object of this invention to provide an effective means for ensuring gun safety.

It is also an object of this invention to provide a gun safety device for a firearm, such that said device is an economical means of ensuring gun safety.

These and other objects and advantages of the present invention will become more readily apparent from the more detailed description of preferred embodiments taken in conjunction with the drawings wherein similar elements are identified by like numerals through several views.

In general, the safety device for a firearm comprises a cable having a first and second end; a plug element firmly affixed to the first end of the cable; a plug ring containing a bore in the center, which traverses along the cable, said plug ring being substantially annular in shape, having an inner diameter which is smaller than the largest diameter of the plug element, and said plug ring having an outer diameter which is slightly smaller than the inner diameter of the barrel of said firearm to assure a friction fit therewith; and a restricting means comprising a plug-like element having a slot cut therein, said slot being open at one end and having a dimension slightly larger than the width of the cable for receiving said cable; said restricting means being freely slidable along said cable; and a locking device for retaining said restricting means on said cable; and a stopper firmly affixed to the second end of the cable.

In one general embodiment, the safety device comprises vinyl coated cable with a stopper on one end, and plug on the other. The product contains several plug rings, with one to be chosen that corresponds to the diameter of the gun barrel. A pinch clamp with a flexible rubber lining, circumscribingly engages the cable near the stopper end. This pinch clamp has restricted movement along the cable. The stopper, clamp, and cable are passed through the hole in the plug ring until the plug ring engages the plug.

One end of the cable, connected to the stopper, is placed through the firearm barrel beginning at the chamber so that the cable protrudes from the end of the gun barrel opposite the chamber, and a restricting means is attached. The cable is drawn tight so that the plug/plug ring combination on the opposite end seats against the barrel opening of the chamber. The clamp can be moved to within ¼" of the restricting means, but between the restricting means and the stopper. Such clamp, when tightened, prevents the restricting means from moving along the cable towards the stopper. The restricting means can be held onto the cable by a locking device. This locking device can be a ring lock, cotter pin or key/padlock. Such an embodiment can be adapted for use with a variety of firearms including, but not limited to, rifles, handguns, and shotguns.

Another embodiment of the present invention utilizes a longer cable such that the plug end may loop around and travel externally along the gun barrel, as well as internally, and be inserted into the slot of the restricting means.

Another embodiment of the present invention utilizes a cable with a plug on one end and a stopper on the other, such that one end of the cable is inserted through the length of the magazine through the chamber and looped back around such that both ends of the cable are held securely in place using a restricting means.

Still another embodiment utilizes a restricting means comprising two cable bores found therein. These bores are of sufficient diameter so as to permit easy passage therethrough by the cable and attached stoppers. A thumbscrew threadably engages a bore formed perpendicular to and intersecting one cable bore, retaining the restricting means at a point along the cable. An additional bore is formed at an angel to and intersecting a cable bore and sized to receive the shaft of a padlock. The padlock or other obstructing means is passed through a portion of the cable bore and serve to prevent the passage of a stopper attached to the cable.

BRIEF DESCRIPTION OF THE DRAWINGS

In order to better understand the present invention, reference is made to the accompanying drawings, wherein.

DETAILED DESCRIPTION OF THE PREFERRED EMBODIMENT

Figure 1:
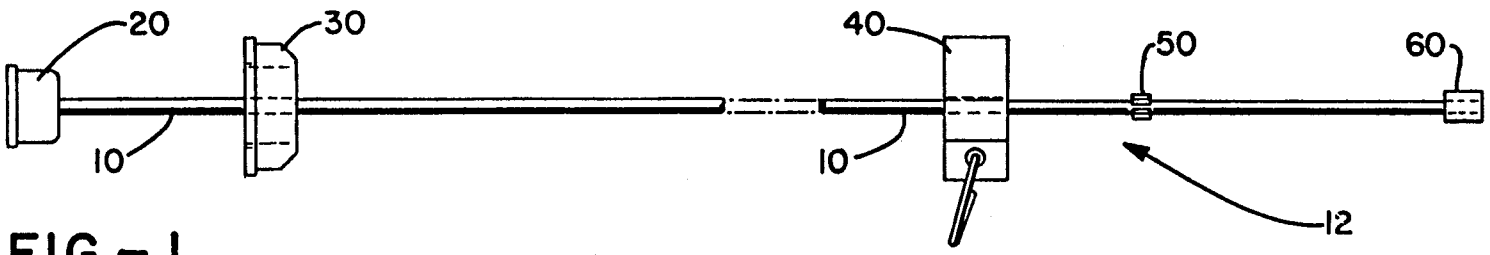
FIG. 1 is a perspective view of one embodiment of a safety device for a firearm according to the present invention.

Now, with reference to the invention illustrated in the drawings, and looking particularly at FIG. 1, the figure shows a longitudinal expanded view of the safety device 12 for a firearm.

The safety device 12 comprises a cable 10, a plug element 20 attached to the first end of the cable, a plug ring 30 surrounding the plug element 20, a slidable restricting means 40 which is slidable along the cable 10, a pinch clamp 50 which functionally engages the cable, and a stopper 60 affixed to the second end of the cable 10.

The cable 10 is an essentially straight strand of wire with a vinyl coating of sufficient length to traverse the length of a firearm barrel and protrude so as to attach a restricting means, having a plug at one end and a stopper at the other end. An anchoring means 26 on cable 10 secures plug element 20 to cable 10 and is illustrated in FIG. 2.

Figure 2:
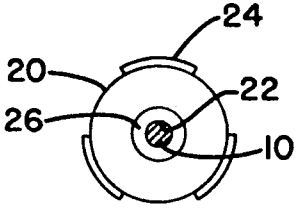
FIG. 2 is a top elevational view of the plug element component of a safety device for a firearm.

The plug element 20, further illustrated in FIG. 2, is essentially cylindrical in shape, has a flange 24 of enlarged diameter at one end (the outer end as assembled on the cable). The plug element 20, preferably made from a molded plastic, has a hole 22 extending longitudinally through its center through which cable 10 passes and is securely affixed. Plug element 20 is securely held in place on one end of cable 10 by anchoring means 26.

Figure 4:
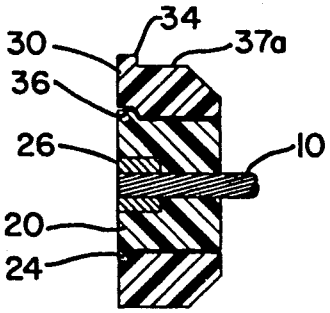
FIG. 4 is a transverse cross-sectional view of the plug ring/plug combination of the safety device for a firearm.
Figure 3B:
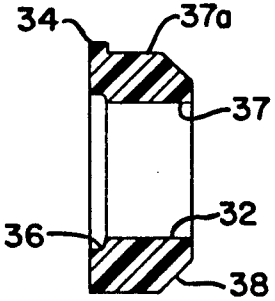
FIG. 3B is a transverse cross-sectional view of the plug ring element of a safety device for a firearm.
Figure 3A:
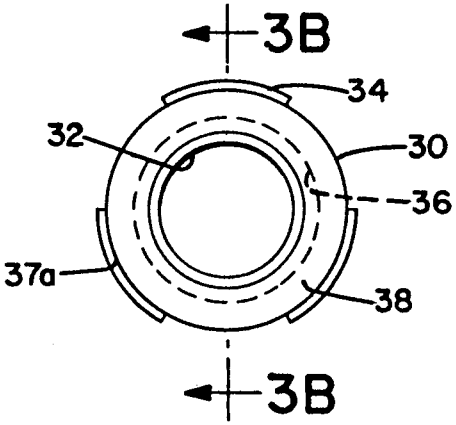
FIG. 3A is a bottom elevational view of the plug ring element of a safety device for a firearm.

Plug ring 30, as further illustrated in FIGS. 3A and 3B, is substantially annular in shape and contains a bore 32 in the center thereof. The bore of plug ring 30 is of just slightly larger diameter than the outside diameter of plug 20, so as to accept plug element 20 and hold said plug in place with a friction fit. The inner diameter of plug ring 30 may vary so as to anticipate a conical shaped plug element 20. Plug ring 30 also has a counterbore of slightly larger diameter at one end forming a shelf 36. When engaged with plug element 20, as illustrated in FIG. 4, the flange 24 of plug element 20 rests on the shelf 36, on the inner surface 37 of plug ring 30 and effectively prevents the passage of plug ring 30 past plug 20. The plug ring 30 possesses a flange 34 on the outer surface adjacent to the shelf 36. The outer surface 37A of the plug ring 30, has a beveled edge 38. One preferred embodiment shows the angle of the beveled edge 38 to be 45° from the horizontal plane. A plurality of plug rings of varying diameters are supplied with the product to serve as adapters for various firearms.

The properly sized plug ring 30 will have an outside diameter just slightly less than the inner diameter of the firearm barrel and be held in place with a friction fit. The plurality of plug rings are preferably made of molded plastic.

Figure 12:
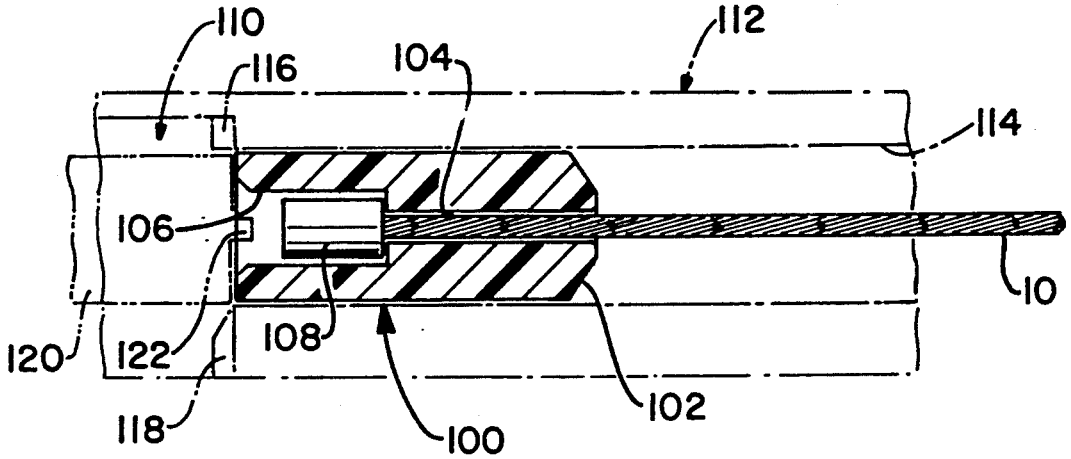
FIG. 12 is a longitudinal cross sectional view of an alternative plug ring for the safety device for a firearm.

A variation of the plug/plug ring combination 20/30 discussed previously herein is illustrated in FIG. 12. This embodiment is especially applicable to rifles and handguns in which it is desirable for the chamber to close completely and the action of the gun to be completely operable. In FIG. 12, the breach 110 of rifle barrel 112 having a bore 114 and a pair of vertically positioned bolt guides 116 and 118 for a bolt 120 of the rifle action. The bolt 120 has a pair of horizontally positioned catches 122 which guide, hold and seat a bullet within the barrel bore 114 in the conventional manner of such actions.

In this embodiment plug 100 is disclosed as a solid elongated cylinder with a tapered nose portion 102. Plug 100 has a bore 104 extending longitudinally through its center through which cable 10 passes. A counterbore 106 is formed at the end of plug 100 opposite nose portion 102. Counterbore 106 is dimensioned with a length and width sufficient to seat anchoring means 108 therein. Plug element 100 has an outer diameter generally corresponding to the diameter of a casing for a round of ammunition used in the respective firearm. In this manner, nose portion 102 of plug element 100 seats against the chamber's barrel opening while simultaneously permitting closure of the chamber.

Figure 5B:
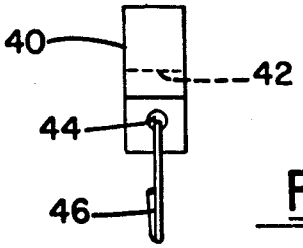
FIGS. 5B–5D are elevational views of the restricting means component of a safety device for a firearm.
Figure 5A:
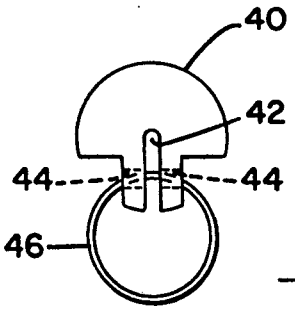
FIG. 5A is a front elevational view of the restricting means component of the safety device for a firearm.
Figure 5C:
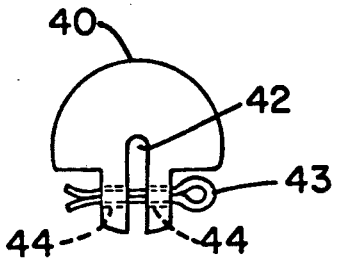
Figure 5D:
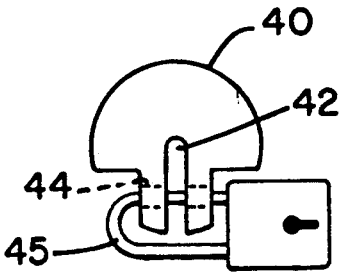

Further along cable 10 in FIG. 1 is the restricting means 40, which is further illustrated in FIGS. 5A and 5B. The restricting means 40, when in place, serves to secure the safety device 12 to the firearm. One preferred embodiment of this invention shows the restricting means 40 as a plug-like device, with a diameter larger than that of the firearm, preferably made from molded plastic, with a slot 42 partially cut through it. The slot 42 has a depth preferably about equal to one-half the diameter of the restricting means 40 and has a width slightly greater than the diameter of the cable 10, so that the restricting means can slide freely along the cable. The restricting means 40 has a hole 44, which is cut through it, perpendicular to and intersecting the slot 42. As cable 10 is passed through the slot 42 of the restricting means 40, the restricting means is held onto the cable by the introduction of a locking device, shown in FIG. 5C as a split ring 46, through the hole 44 of the restricting means 40. Split ring 46 can be opened so as to install or remove said ring from the restricting means 40. Alternative embodiments of the locking device may include cotter pins or key/padlock systems.

Figure 6:
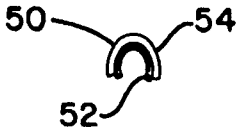
FIG. 6 is a front elevational view of the clamp component of the safety device for a firearm.

Still further along cable 10 of FIG. 1 is the pinch clamp 50, which is further illustrated in FIG. 6. The clamp 50 is a metallic clamp means 54 preferably made of a soft metal such as brass and has a flexible rubber lining 52 inside the clamp which comes in direct contact with cable 10. Clamp 50 frictionally engages the cable, so that the clamp can be slid along the cable but holds its position until moved by someone. The clamp 50 serves to prevent the restricting means 40 from moving toward the stopper end of the cable. The clamp 50 also serves as a guide for re-attaching the restricting means 40 to the cable.

Finally, a cylindrical metal stopper 60 is permanently affixed to the second end of the cable 10 to contain the clamp 50 and the restricting means 40 on the length of cable 10.

A modified form of the safety device, herein, is one in which the cable 10 is shorter in length than the embodiment shown in FIGS. 1–7 and the plug ring 30 may engage the barrel or simply block the chamber. This embodiment, shown in FIG. 8, is particularly useful with handguns. When used with revolvers having a rotating cylinder mechanism, the plug/plug ring combination 20/30 also prevents the closing of the cylinder.

Figure 7:
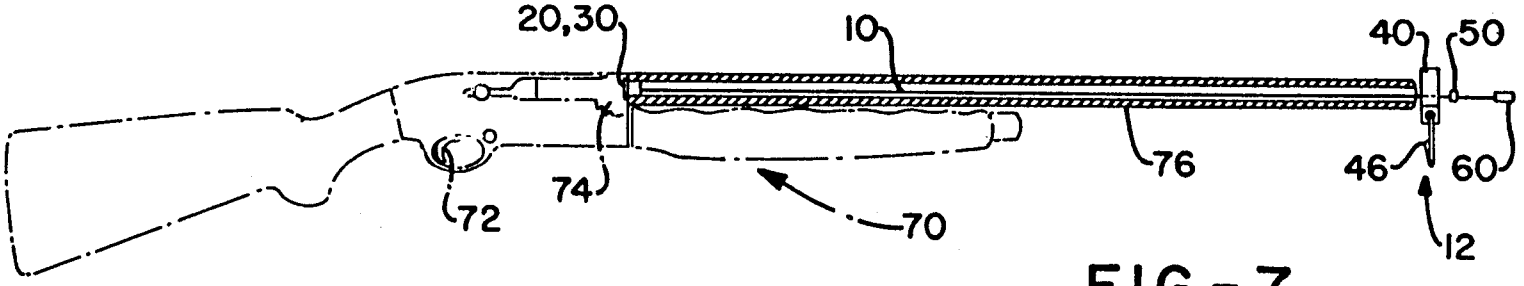
FIG. 7 is a longitudinal cross-sectional view of a rifle/shotgun, with one preferred embodiment of a safety device for a firearm installed therein.
Figure 8:
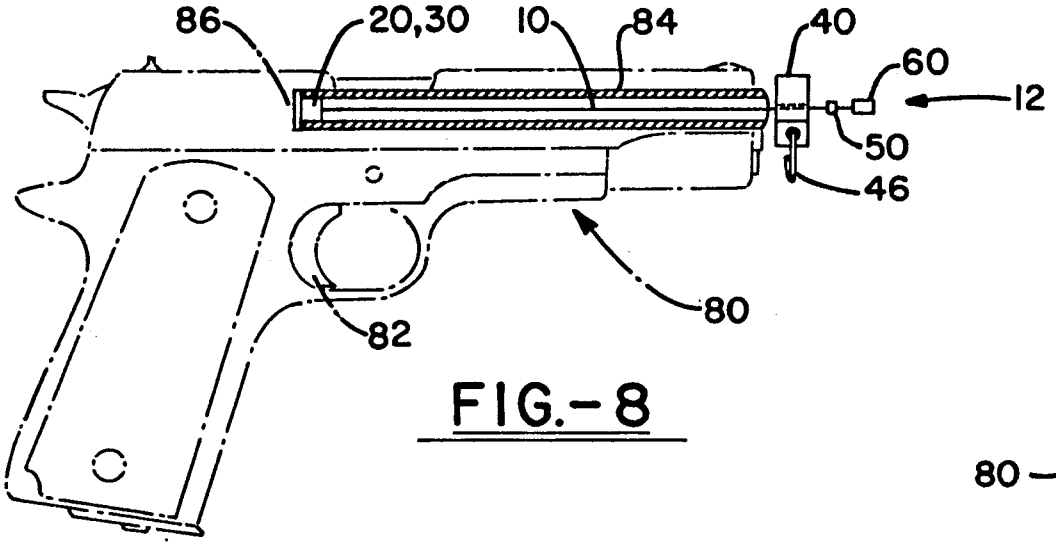
FIG. 8 is a longitudinal cross-sectional view of a handgun with one preferred embodiment of the safety device for a firearm installed therein.
Figure 9:
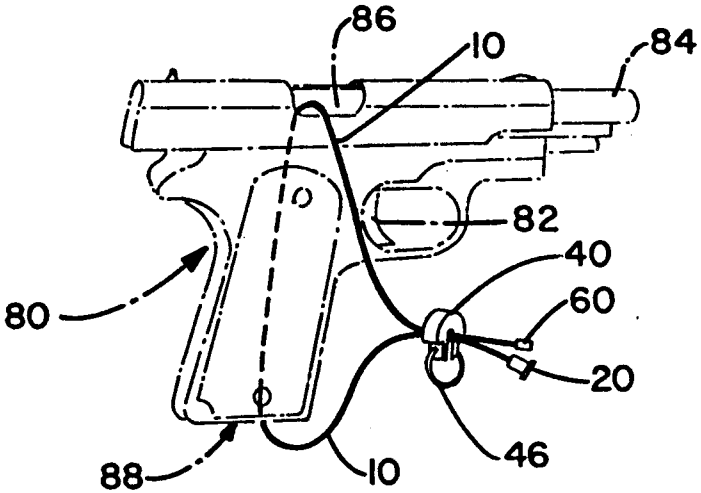
FIG. 9 is a longitudinal cross-sectional view of a handgun with another preferred embodiment of the safety device for a firearm installed therein.

FIGS. 7–9 illustrate the safety device as installed on several types of firearms. The user when installing the embodiment shown in FIG. 7 selects a plug ring from the plurality of plug rings supplied. The selected plug ring should have an outer diameter slightly less than the inner diameter of the firearm barrel 76. When using the device with a handgun as shown in FIG. 8, a single plug ring with a flange diameter larger than the internal diameter of the gun barrel 84 is supplied. The stopper 60, cable 10 and clamp 50 are passed through the bore of the selected plug ring 30. The plug ring is slid down the length of the cable and slipped onto the plug 20. The flange of the plug should rest on the inner shelf 36 of the plug ring 30 such that the flanged surface of the plug and the flanged surface of the plug ring achieve a flush fit.

Referring now to FIG. 7, the safety device 12 is inserted into the firearm barrel from the firearm chamber 74. The stopper 60 is passed into the barrel first. The safety device is continually passed into the barrel until the stopper 60 is visibly out of the barrel's other end. The user holds the stopper and pulls the cable 10 until the plug/plug ring combination seats against the barrel opening of the chamber. The cable 10, visible from the gun barrel, is passed through the slot 42 of the restricting means 40. A split ring 46 is inserted through the hole 44 to hold restricting means 40 onto the cable. The clamp 50 is moved down the cable to a distance approximately ¼" from the restricting means 40. When tightened, this clamp 50 serves to prevent the restricting means from moving toward the second end of the cable. The clamp 50 also serves as a guide for the restricting means 40 when re-attaching it to the cable.

The safety device 12 when installed prevents the firearm from being loaded with ammunition. The plug/-plug ring combination 20/30 blocks the entrance of ammunition into the chamber.

Figure 11:
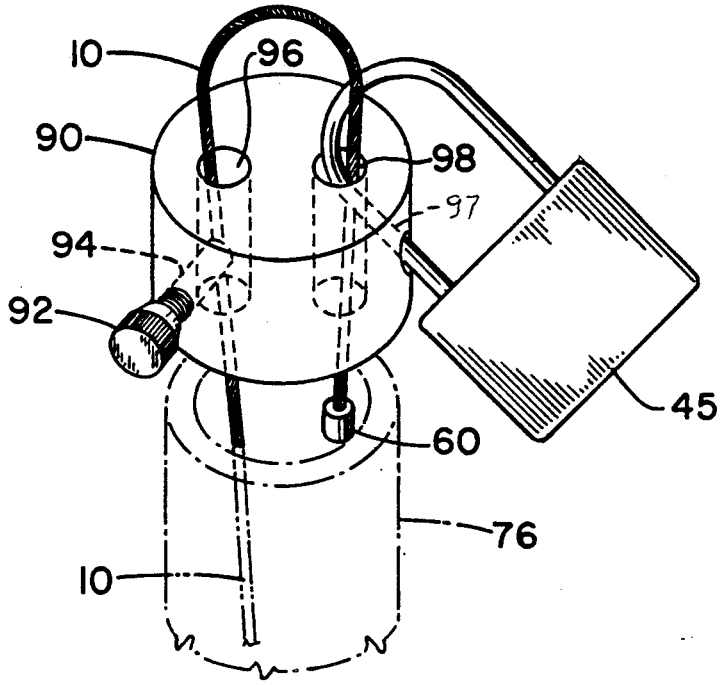
FIG. 11 is a perspective view of an alternative embodiment for a restricting means of a safety device for a firearm.

An alternative embodiment of the restricting means of the present invention is disclosed in FIG. 11. The restricting means 90 is shown as a disc-shaped plug element with two planar faces. Restricting means 90 has two bores 96 and 98 passing through the restricting means 90 and having an opening on each planar face. Bores 96 and 98 are of sufficient diameter to allow easy passage of cable 10 and stopper 60 therethrough.

A threaded bore 94 is formed perpendicular to bore 96 and intersecting the same. Bore 94 is dimensioned to threadably engage the threaded shaft portion of a thumb screw 92.

A bore 97 is formed at an angle to bore 98 and intersecting the same. Bore 97 is sized to have a diameter greater than the diameter of the shaft of padlock 45.

In this alternative embodiment, the invention is inserted into a firearm as previously described. However, restricting means 90 is used in place of restricting means 40. The cable 10, again visible through the gun barrel, is passed through bore 96. Cable 10 is pulled so that plug/-plug ring combination 20/30 seats against the barrel opening in the chamber and restricting means 90 is moved down cable 10 in proximity with the end of barrel 76. Cable 10 is then looped 180° and passed through bore 98. Thumb screw 92 is rotated within bore 94 so as to tighten and hold cable 10 in place against the inner wall of bore 96. A padlock 45, split ring 46 or cotter pin 43 is passed through bore 97 and a portion of bore 98 to obstruct bore 98 and to prevent the passage of stopper 60 back through bore 98. Therefore, it is obvious that while it is desirable for stopper 60 to initially pass easily through bore 98, bore 98 should not be dimensioned so wide as to allow stopper 60 to pass therethrough in the present of an obstruction such as the padlock 45, etc.

Thumb screw 92 eliminates the need for clamp 50 of previous embodiments and allows the safety device 12 to be quickly and easily adapted for use on various guns if desired. Padlock 45 or other means of obstructing bore 98 serve to prevent unauthorized removal of safety device 12 from a firearm even if thumb screw 92 is loosened or removed. In this embodiment it is imperative that stopper 60 be securely attached to cable 10.

While the preferred embodiment of restricting means 90 is shown in FIG. 11, it is appreciated that variations of this restricting means are possible. For instance, restricting means 90 can comprise a threaded bore 94 and angled bore 97 intersecting a single cable bore 96 at different points. Additionally although cable bores 96 and 98 are disclosed in a parallel orientation, their orientation to each other is not critical.

In the case of a firearm possessing a revolving cylinder mechanism the plug/plug ring combination 20/30 blocks the chamber and prevents the cylinder from closing.

A variation of the embodiment is present when the cable is of such length that the plug end of the cable 10 loops around the exterior of the gun and is passed through the restricting means 40.

A further variation on the preferred embodiment, as illustrated in FIG. 9, occurs when the user inserts the safety device 12, stopper end first, into the gun magazine 88 and through the gun chamber 86 instead of the gun barrel. The plug end and the stopper end of cable 10 are brought together and the cable from each end is passed through the slot 42 of restricting means 40. The cables are held in said slot by locking device 46 passed through hole 44 of restricting means 40. The plug rings 30 are not required in this embodiment. This manner of securing a firearm prevents ammunition from being entered through the magazine 88 and prevents the chamber 86 from closing, thereby making it impossible for the gun to fire. This embodiment, like the others, provides a visible indication that the gun is not loaded.

Figure 10:
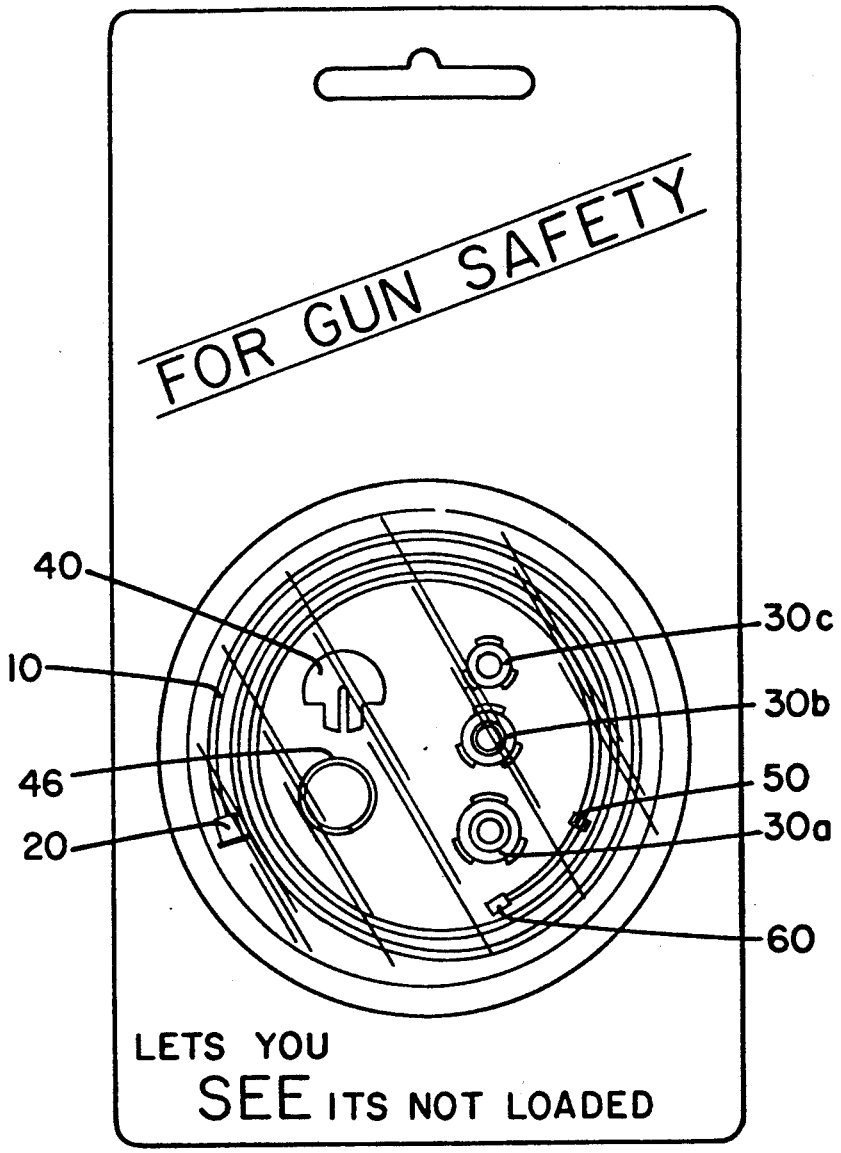
FIG. 10 is a perspective view of a kit containing one preferred embodiment of a safety device for a firearm.

The various embodiments are to be sold in a kit as illustrated in FIG. 10, containing a vinyl coated cable 10 with plug 20 on one end and stopper 60 on the second end; a pinch clamp 50 attached to the cable; a plurality of plug rings, one being selected which corresponds to the diameter of the firearm; a restricting means 40; and a locking device, shown here as a split ring.

While in accordance with the patent statutes the best mode and preferred embodiment of the invention has been described, it is to be understood that the invention is not limited thereto, but rather is to be measured by the scope and spirit of the appended claims.

What is claimed is:

1. A safety device for a firearm having a barrel with a first end and a second end which comprises:

(a) a cable having a first end and a second end;

(b) a plug element firmly affixed to the first end of the cable;

(c) a stopper firmly affixed to the second end of the cable;

(d) a restricting means comprising a plug like element having a diameter greater than a diameter of said firearm barrel, said restricting means comprising at least one cable bore formed therein, said bore having two open ends and a diameter slightly larger than a diameter of said stopper such that said bore is capable of receiving said cable therethrough and a means for securing said restricting means to said cable; and (e) a locking device inserted through at least a portion of said cable bore in said restricting means for retaining said restricting means on said cable.

2. The safety device for a firearm are recited in claim 1 wherein said restricting means further comprises a threaded bore formed therein perpendicular to an intersecting cable bore and wherein said securing means is a securing screw threadably engaging said threaded bore to retain said cable between said screw and an inner wall of said cable bore.

3. The safety device for a firearm as recited in claim 1 further comprising at least a second cable bore dimensioned essentially equal to said first cable bore and capable of receiving said cable therethrough.

4. The safety device for a firearm as recited in claim 1 wherein the locking device is a lock.

5. The safety device for a firearm as recited in claim 1 wherein the locking device is a split ring.

6. The safety device for a firearm as recited in claim 1 wherein the locking device is a cotter pin.

7. The safety device for a firearm as recited in claim 1 wherein said restricting means further comprises an angular bore intersecting at least one cable bore and capable of passage therethrough by said locking device.

8. The safety device of claim 1 wherein the device further comprises a plug ring being substantially annular in shape and containing a bore in its center, said plug ring capable of traversing along said cable and dimensioned so as to have an inner diameter slightly less than a diameter of said plug element and capable of engaging said plug element with a friction fit.

9. The safety device of claim 8 wherein an outer diameter of said plug ring is slightly smaller than the inner diameter of the barrel of said firearm so as to assure a friction fit therewith.

10. The safety device of claim 1 wherein said plug element is dimensioned so as to seat in said firearm chamber against said first end of said firearm barrel to prevent insertion of ammunition into the chamber and permit closure of said chamber.

* * * * *